US009651885B2

(12) United States Patent
Kobayashi et al.

(10) Patent No.: US 9,651,885 B2
(45) **Date of Patent: *May 16, 2017**

(54) ELECTROSTATIC LATENT IMAGE DEVELOPING TONER

(71) Applicant: KYOCERA Document Solutions Inc., Osaka-shi, Osaka (JP)

(72) Inventors: Ryota Kobayashi, Osaka (JP); Masami Tsujihiro, Osaka (JP); Jun Hioki, Osaka (JP); Yusuke Washino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/045,991

(22) Filed: Feb. 17, 2016

(65) Prior Publication Data

US 2016/0246201 A1 Aug. 25, 2016

(30) Foreign Application Priority Data

Feb. 23, 2015 (JP) ..... 2015-033082

(51) Int. Cl.
*G03G 9/08* (2006.01)
*G03G 9/093* (2006.01)

(52) U.S. Cl.
CPC ..... *G03G 9/09314* (2013.01); *G03G 9/0821* (2013.01); *G03G 9/09328* (2013.01)

(58) Field of Classification Search
CPC ..... G03G 9/09328; G03G 9/09314
USPC ..... 430/110.2
See application file for complete search history.

(56) References Cited

U.S. PATENT DOCUMENTS 9,523,937 B2 * 12/2016 Tsujihiro ..... G03G 9/09328 430/110.2
2005/0271964 A1 12/2005 Etou et al.

FOREIGN PATENT DOCUMENTS

JP 2004-138985 A 5/2004

* cited by examiner

*Primary Examiner* — Mark A Chapman
(74) *Attorney, Agent, or Firm* — Studebaker & Brackett PC

(57) ABSTRACT

An electrostatic latent image developing toner includes toner particles that each include a toner core and a shell layer disposed over a surface of the toner core. The shell layer contains a hydrophobic thermoplastic resin and a hydrophilic thermosetting resin. The hydrophobic thermoplastic resin is contained in an amount of no less than 0.2% by mass and no greater than 4.7% by mass relative to mass of the toner particles. The hydrophilic thermosetting resin is contained in an amount of no less than 0.01% by mass and no greater than 0.71% by mass relative to mass of the toner particles. The hydrophobic thermoplastic resin is exposed at a surface of each of the toner particles.

5 Claims, 5 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-033082, filed on Feb. 23, 2015. The contents of this application are incorporated herein by reference in their entirety.

BACKGROUND

The present disclosure relates to an electrostatic latent image developing toner (hereinafter, may be referred to as a toner).

A toner that has favorable fixability even when heating thereof by a fixing roller is kept at a minimal level is preferable in terms of energy efficiency and miniaturization of image forming apparatuses. A toner having excellent low-temperature fixability is typically prepared using a binder resin having a low melting point or glass transition point, or using a releasing agent having a low melting point. However, a toner such as described above tends to suffer from a problem of the toner particles included therein aggregating when the toner is stored at high temperatures. In a situation in which toner particles aggregate, the aggregated toner particles tend to have a lower charge than other toner particles that are not aggregated.

A toner including toner particles that have a core-shell structure may be used in order to achieve an objective of obtaining a toner with excellent low-temperature fixability, high-temperature stability, and blocking resistance. For example, a toner that includes toner particles has been considered. The toner cores of the toner particles have surfaces coated by thin films containing a thermosetting component and have a softening temperature of no less than 40° C. and no greater than 150° C.

SUMMARY

An electrostatic latent image developing toner according to an embodiment of the present disclosure includes toner particles that each include a toner core and a shell layer disposed over a surface of the toner core. The shell layer contains a hydrophobic thermoplastic resin and a hydrophilic thermosetting resin. The hydrophobic thermoplastic resin is contained in an amount of no less than 0.2% by mass and no greater than 4.7% by mass relative to mass of the toner particles. The hydrophilic thermosetting resin is contained in an amount of no less than 0.01% by mass and no greater than 0.71% by mass relative to mass of the toner particles. The hydrophobic thermoplastic resin is exposed at a surface of each of the toner particles.

DETAILED DESCRIPTION

Figure 1:
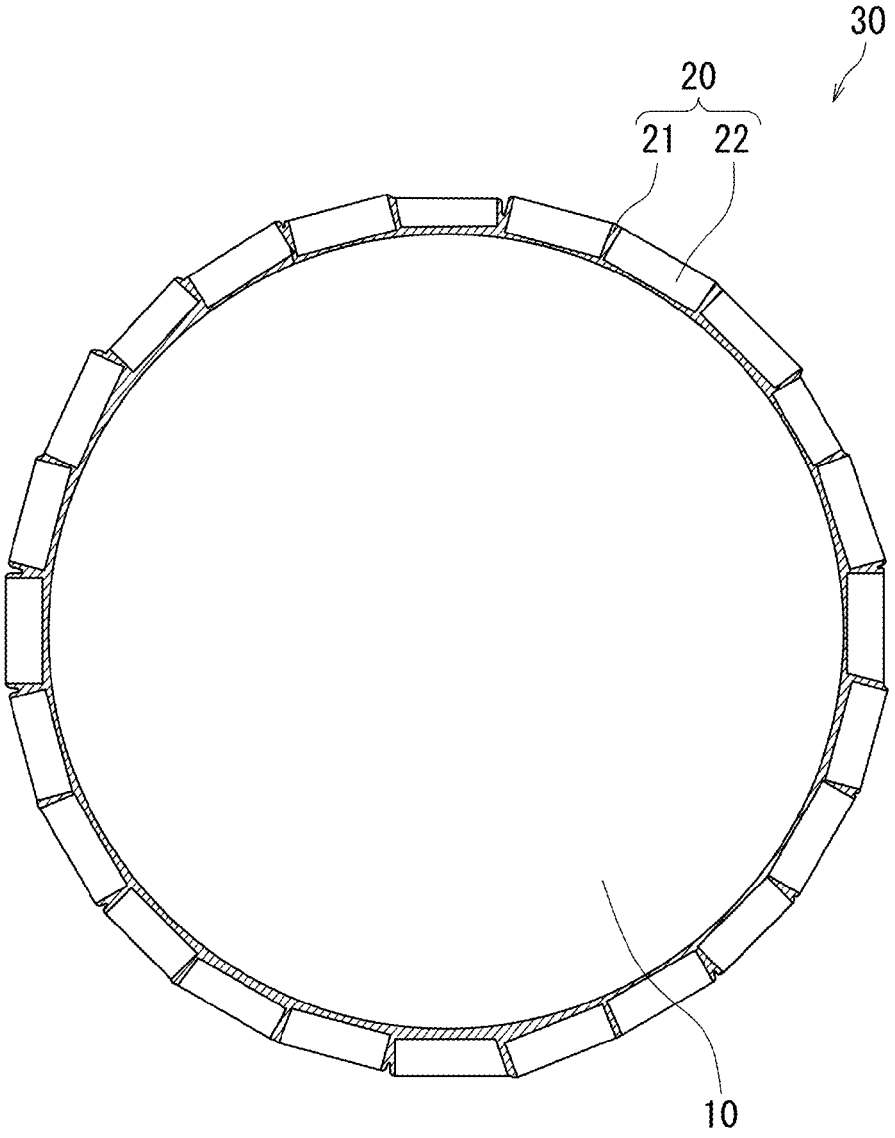
FIG. 1 is a diagram illustrating a toner particle included in a toner according to an embodiment of the present disclosure.

The following explains an embodiment of the present disclosure. The present disclosure is not in any way limited by the embodiment described below and appropriate variations may be made in practice within the intended scope of the present disclosure. Although explanation is omitted as appropriate in some instances in order to avoid repetition, such omission does not limit the essence of the present disclosure.

The term "(meth)acrylic" is used herein as a generic term for both acrylic and methacrylic. The term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

An average value used herein refers to an arithmetic mean value unless otherwise stated. When evaluation values (for example, values indicating shapes or properties) pertaining to powders (for example, toner, toner particles, toner mother particles, toner cores, and external additives to be described later) are given, such evaluation values are also arithmetic mean values (number average values) unless otherwise stated. An arithmetic mean value is obtained by adding up values measured with respect to an appropriate number of measurement targets and dividing the sum by the number. The particle size of a powder is the diameter of a representative circle of a primary particle measured using an electron microscope unless otherwise stated. The diameter of a representative circle is the diameter of a circle having the same area as a projection of the particle.

The present embodiment relates to a toner. The toner according to the present embodiment is a powder including a large number of toner particles. The toner according to the present embodiment can be used, for example, in an electrophotographic apparatus (image forming apparatus).

An electrophotographic apparatus develops an electrostatic latent image using a developer that includes a toner. Through the development, charged toner adheres to the electrostatic latent image which has been formed on a photosensitive member. After transfer of the adhered toner onto a transfer belt, a toner image on the transfer belt is transferred onto a recording medium (for example, paper). Alternatively, the adhered toner is directly transferred onto a recording medium (for example, paper). The toner is subsequently heated to fix the toner to the recording medium. As a result, an image is formed on the recording medium. A full-color image can for example be formed by superimposing toner images of four different colors: black, yellow, magenta, and cyan.

The toner according to the present embodiment have the following features (1) and (2).

(1) The toner particles each include a toner core and a shell layer coating a surface of the toner core. The shell layer is disposed over the surface of the toner core. The shell layer contains a hydrophilic thermosetting resin and a hydrophobic thermoplastic resin.

(2) The hydrophobic thermoplastic resin is contained in an amount of no less than 0.2% by mass and no greater than 4.7% by mass relative to mass of the toner particles. The hydrophilic thermosetting resin is contained in an amount of no less than 0.01% by mass and no greater than 0.71% by mass relative to mass of the toner particles. The hydrophobic thermoplastic resin is exposed at a surface of each of the toner particles.

The feature (1) is advantageous for achieving both high-temperature preservability and low-temperature fixability of the toner. More specifically, the shell layers that coat the toner cores are expected to improve high-temperature preservability of the toner. The hydrophilic thermosetting resin is expected to contribute to the improvement in high-temperature preservability of the toner, and the hydrophobic thermoplastic resin is expected to contribute to the improvement in low-temperature fixability of the toner.

The feature (2) is advantageous for restricting charge decay of the toner. More specifically, as a result of the hydrophobic thermoplastic resin content and the hydrophilic thermosetting resin content being within the ranges specified as the feature (2), the toner is likely to have a structure in which the hydrophobic thermoplastic resin is exposed at the surface of each of the toner particles. As a result of the hydrophobic thermoplastic resin being exposed at the surface of each of the toner particles, the surface of the toner particle is resistant to moisture adsorption even in a high temperature and humidity environment. A toner having the feature (2) therefore has improved charge retention, and therefore charge decay of the toner is restricted. It can for example be confirmed that the hydrophobic thermoplastic resin is exposed at the surface of each of the toner particles through observation of the toner particle using an SEM, a TEM, or an SPM described later.

The toner according to the present embodiment includes toner particles having both the feature (1) and the feature (2) (hereinafter, referred to as toner particles of the present embodiment). The toner including the toner particles of the present embodiment is excellent in high-temperature preservability, low-temperature fixability, and charge retention (see Tables 1 and 2 presented later). The toner preferably includes no less than 80% by number of the toner particles of the present embodiment, more preferably no less than 90% by number of the toner particles of the present embodiment, and still more preferably 100% by number of the toner particles of the present embodiment.

In order to improve both low-temperature fixability and high-temperature preservability of the toner, the toner preferably has the following feature (3) in addition to the features (1) and (2).

(3) In the shell layer, a plurality of blocks substantially composed of the hydrophobic thermoplastic resin are included (located) such that the blocks are connected to one another via a junction portion substantially composed of the hydrophilic thermosetting resin. The junction portion is equivalent to a boundary portion between the blocks. The amount of the hydrophobic thermoplastic resin contained in the blocks is preferably no less than 80% by mass, more preferably no less than 90% by mass, and most preferably 100% by mass. The amount of the hydrophilic thermosetting resin contained in the junction portion is preferably no less than 80% by mass, more preferably no less than 90% by mass, and most preferably 100% by mass.

The following explains the toner having the features (1) to (3) with reference to FIGS. 1 to 5.

FIG. 1 illustrates a toner particle 30 included in the toner according to the present embodiment. The toner particle 30 includes a toner core 10 and a shell layer 20 disposed over the toner core 10. The shell layer 20 includes a junction 21 and blocks 22. The junction portion 21 is substantially composed of a hydrophilic thermosetting resin. The blocks 22 are substantially composed of a hydrophobic thermoplastic resin. In the shell layer 20, the blocks 22 are formed in regions separated from one another by the junction portion 21. The blocks 22 are exposed at the surface of the toner particle 30. Note that the shell layer 20 may also include blocks 22 that are not exposed at the surface of the toner particle.

Figure 2:
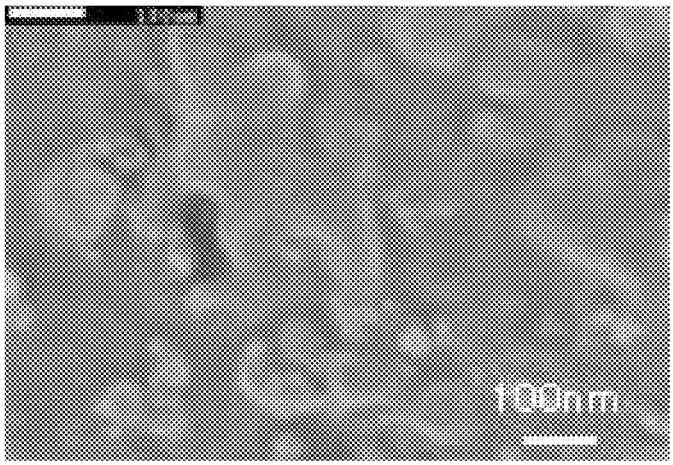
FIG. 2 is an SEM photograph showing a structure of a shell layer in the toner according to the embodiment of the present disclosure.
Figure 3:
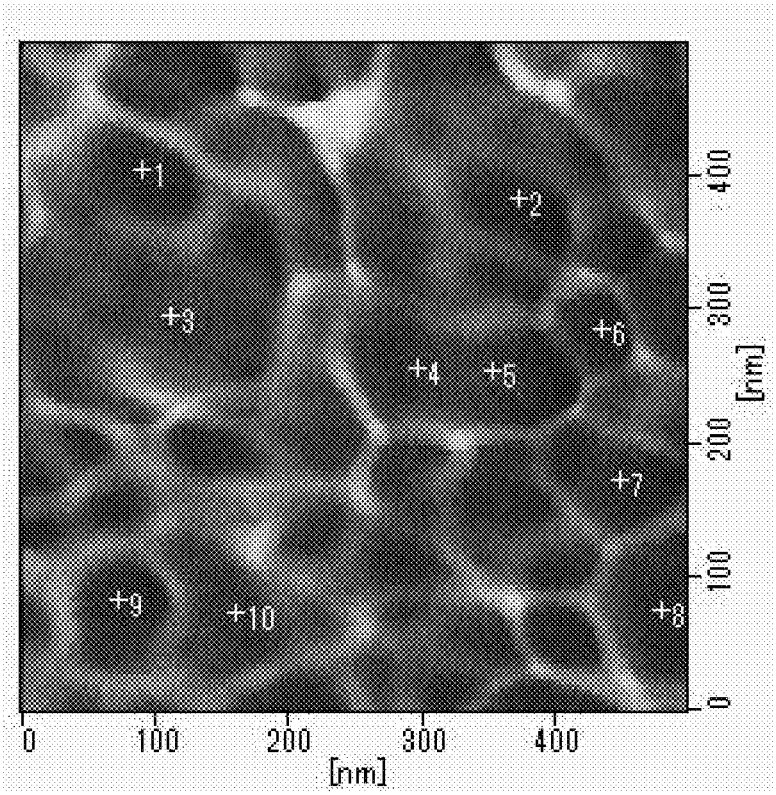
FIG. 3 is an SPM photograph showing a structure of a shell layer in the toner according to the embodiment of the present disclosure.

FIG. 2 is a scanning electron microscope (SEM) photograph showing a structure of the shell layer in the toner having the features (1) to (3). FIG. 2 is an SEM photograph captured at a magnification of ×100,000. FIG. 3 is a scanning probe microscope (SPM) photograph showing the structure of the shell layer in the toner having the features (1) to (3). FIG. 3 is an SPM photograph captured at a magnification of ×200,000. As shown in FIGS. 2 and 3, the blocks 22 and the junction portion 21 form a sea-island structure at the surface (shell layer 20) of the toner particle 30.

Figure 4:
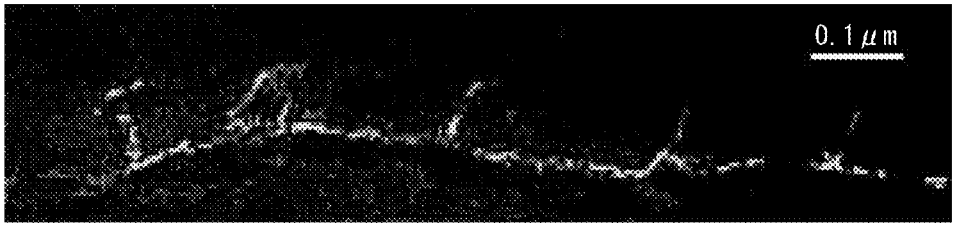
FIG. 4 is a TEM photograph of a cross-section of a toner particle in the toner according to the embodiment of the present disclosure.

FIG. 4 is a transmission electron microscopy (TEM) photograph of a cross-section of the toner particle 30 having the features (1) to (3). FIG. 4 is a TEM photograph captured at a magnification of ×150,000. More specifically, FIG. 4 is a TEM photograph of a cross-section of the toner particle 30 having the feature (3) that was taken by using TEM and electron energy loss spectroscopy (EELS). As shown in FIG. 4, at the surface of the toner particle 30 included in the toner, the hydrophilic thermosetting resin (equivalent to the junction portion 21) that contains a large number of nitrogen atoms is distributed to cover the surface of the toner core. The hydrophilic thermosetting resin has projections in places. The hydrophobic thermoplastic resin (equivalent to the blocks 22) is distributed to fill regions between the projections. The hydrophobic thermoplastic resin is exposed at the surface of the toner particle 30.

It can for example be confirmed that the junction portion 21 is substantially composed of the hydrophilic thermosetting resin by performing mapping of an element that is characteristic of the hydrophilic thermosetting resin (for example, nitrogen) in a TEM image of a cross-section of the toner particle 30 captured by using TEM and EELS. It can for example be confirmed that the blocks 22 are substantially composed of the hydrophobic thermoplastic resin by performing mapping of an element that is characteristic of the hydrophobic thermoplastic resin in a TEM image of a cross-section of the toner particle 30 captured by using TEM and EELS. Alternatively, it can be confirmed that the blocks 22 are substantially composed of the hydrophobic thermoplastic resin by performing mapping of an element that is characteristic of the hydrophilic thermosetting resin in a TEM image of a cross-section of the toner particle 30 captured by using TEM and EELS, and confirming that a resulting map does not include the blocks 22 (the blocks 22 in the TEM image after mapping do not include the element that is characteristic of the hydrophilic thermosetting resin).

Figure 5:
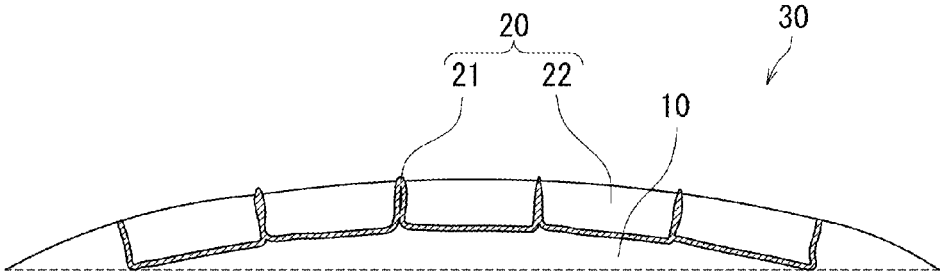
FIG. 5 is an enlarged view of a structure of a shell layer in the toner according to the embodiment of the present disclosure.

FIG. 5 is an enlarged view of the structure of the shell layer 20 in the toner having the features (1) to (3). The following further describes the structure of the shell layer 20 with reference mainly to FIG. 5.

As illustrated in FIG. 5, the junction portion 21 is formed to be walls between the blocks 22. That is, the blocks 22 are partitioned by the walls of the junction portion 21. Furthermore, a film of the junction portion 21 is present in gaps between the blocks 22 and the toner core 10. The film of the junction portion 21 is connected with the walls of the junction portion 21 such that the entirety of the junction portion 21 has an integrated structure. However, the film of the junction portion 21 may not be completely connected with the walls of the junction portion 21 and may be partially separated.

The hydrophobic thermoplastic resin softens upon heating to or beyond a glass transition point (Tg) thereof. However, the hydrophobic thermoplastic resin (blocks 22) is partitioned by the hydrophilic thermosetting resin (junction portion 21) in the shell layers of the toner having the features (1) to (3). Therefore, the toner particle 30 tends not to deform even if the temperature of the shell layer reaches Tg of the hydrophobic thermoplastic resin. In a toner manufactured under appropriately adjusted conditions, deformation of the toner particle 30 only begins once heat and pressure are simultaneously applied to the toner particle 30. Toner particles in such a toner are inhibited from aggregating in a state in which force is not applied to the toner. The toner having the features (1) to (3) is therefore excellent in both high-temperature preservability and low-temperature fixability.

So far, the toner having the features (1) to (3) has been described with reference to FIGS. 1 to 5. The following further describes the toner of the present embodiment.

The toner particles each include a toner core and a shell layer disposed over a surface of the toner core. The toner core contains a binder resin. The toner particles may include optional components (for example, a colorant, a releasing agent, a charge control agent, or a magnetic powder) in the binder resin as necessary.

The term "toner mother particles" may be used to refer to toner particles prior to treatment with an external additive. An external additive may be added to the surfaces of the toner mother particles as necessary. A plurality of shell layers may be layered on the surface of each of the toner cores.

The toner may be used as a one-component developer. Alternatively, the toner may be mixed with a desired carrier to prepare a two-component developer.

[Toner Cores]

The toner cores contain a binder resin. The toner cores may contain an internal additive (for example, a colorant, a releasing agent, a charge control agent, or a magnetic powder).

(Binder Resin)

The binder resin is typically a main component (for example, a component contained in an amount of no less than 85% by mass) in the toner cores. Therefore, properties of the binder resin are thought to have a large influence on overall properties of the toner cores. For example, in a situation in which the binder resin has an ester group, a hydroxyl group, an ether group, an acid group, or a methyl group, the toner cores have a stronger tendency to be anionic. In a situation in which the binder resin has an amino group, an amine, or an amide group, the toner cores have a stronger tendency to be cationic. In order that the binder resin is strongly anionic, the binder resin preferably has a hydroxyl value (OHV) and an acid value (AV) that are each no less than 10 mg KOH/g, and more preferably each no less than 20 mg KOH/g.

The binder resin preferably has at least one chemical group selected from the group consisting of an ester group, a hydroxyl group, an ether group, an acid group (for example, carboxyl group), and a methyl group, and more preferably has either or both of a hydroxyl group and a carboxyl group. A binder resin having a functional group such as described above readily reacts with a shell material (for example, methylol melamine) to form chemical bonds. Formation of chemical bonds between the binder resin and the shell material ensures strong bonding between the toner cores and the shell layers. Also, the binder resin preferably has a functional group including active hydrogen in molecules thereof.

The binder resin preferably has a glass transition point (Tg) that is no greater than a curing onset temperature of the shell material. It is thought that as a result of using a binder resin having Tg such as described above, fixability of the toner tends to be sufficient even during high speed fixing.

Tg of the binder resin can be measured using, for example, a differential scanning calorimeter. More specifically, Tg of the binder resin can be obtained from a point of change of specific heat on a heat absorption curve that is plotted by measuring a sample (i.e., the binder resin) using the differential scanning calorimeter.

The binder resin preferably has a softening point (Tm) of no greater than 100° C., and more preferably no greater than 95° C. As a result of Tm of the binder resin being no greater than 100° C., fixability of the toner tends to be sufficient even during high speed fixing. Furthermore, in a situation in which Tm of the binder resin is no greater than 100° C., partial softening of the toner cores tends to occur during a curing reaction of the shell layers when the shell layers are formed on the surfaces of the toner cores in an aqueous medium. As a result, the toner cores tend to become round in shape due to surface tension. Tm of the binder resin can be adjusted by using a combination of resins with differing Tm as the binder resin.

Tm of the binder resin can be measured using, for example, a capillary rheometer. More specifically, melt flow of a sample (binder resin) set in the capillary rheometer is caused under specific conditions. Then, an S-shaped curve of the binder resin is plotted. Tm of the binder resin can be read from the S-shaped curve that is plotted. Tm of the measurement sample (binder resin) is a temperature (° C.) on the S-shaped curve corresponding to a stroke value of $(S_1+S_2)/2$, where $S_1$ represents a maximum stroke value and $S_2$ represents a base line stroke value at low temperatures.

The binder resin is preferably a thermoplastic resin. Preferable examples of thermoplastic resins that can be used as the binder resin include styrene-based resins, acrylic acid-based resins, olefin-based resins (specific examples include polyethylene resin and polypropylene resin), vinyl resins (specific examples include vinyl chloride resin, polyvinyl alcohol resin, vinyl ether resin, and N-vinyl resin), polyester resins, polyamide resins, urethane resins, styrene-acrylic acid-based resins, and styrene-butadiene-based resins. Among the resins listed above, styrene-acrylic acid-based resins and polyester resins are preferable in terms of improving colorant dispersibility in the toner cores, toner chargeability, and toner fixability with respect to a recording medium.

The following explains a styrene-acrylic acid-based resin that can be used as the binder resin. The styrene-acrylic acid-based resin is a copolymer of a styrene-based monomer and an acrylic acid-based monomer (styrene-acrylic acid-based copolymer).

Preferable examples of styrene-based monomers include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers include (meth)acrylic acid, alkyl (meth)acrylates, and hydroxyalkyl (meth)acrylates. Specific Examples of alkyl (meth)acrylates include methyl (meth)acrylate, ethyl (meth) acrylate, n-propyl (meth)acrylate, iso-propyl (meth)acrylate, n-butyl (meth)acrylate, iso-butyl (meth)acrylate, and 2-ethylhexyl (meth)acrylate. Specific examples of hydroxyalkyl (meth)acrylates include 2-hydroxyethyl (meth)acrylate, 3-hydroxypropyl (meth)acrylate, 2-hydroxypropyl (meth) acrylate, and 4-hydroxybutyl (meth)acrylate.

A hydroxyl group can be introduced into the styrene-acrylic acid-based resin by using a monomer having a hydroxyl group (specific examples include p-hydroxystyrene, m-hydroxystyrene, and hydroxyalkyl (meth)acrylates) in preparation of the styrene-acrylic acid-based resin. The hydroxyl value of the prepared styrene-acrylic acid-based resin can be adjusted by adjusting the amount of the monomer having the hydroxyl group that is used.

A carboxyl group can be introduced into the styrene-acrylic acid-based resin by using (meth)acrylic acid (monomer) in preparation of the styrene-acrylic acid-based resin. The acid value of the prepared styrene-acrylic acid-based resin can be adjusted by adjusting the amount of (meth) acrylic acid that is used.

In a situation in which the styrene-acrylic acid-based resin is used as the binder resin, the styrene-acrylic acid-based resin preferably has a number average molecular weight (Mn) of no less than 2,000 and no greater than 3,000 in order to improve toner core strength and toner fixability. The styrene-acrylic acid-based resin preferably has a molecular weight distribution (i.e., a ratio Mw/Mn of mass average molecular weight (Mw) relative to number average molecular weight (Mn)) of no less than 10 and no greater than 20. Mn and Mw of the styrene-acrylic acid-based resin can be measured by gel permeation chromatography.

The following explains a polyester resin that can be used as the binder resin. The polyester resin can be prepared through condensation polymerization or copolymerization of a di-, tri-, or higher-hydric alcohol with a di-, tri-, or higher-basic carboxylic acid.

Examples of di-hydric alcohols that can be used to prepare the polyester resin include diols and bisphenols.

Preferable examples of diols that can be used include ethylene glycol, diethylene glycol, triethylene glycol, propylene glycol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used include bisphenol A, hydrogenated bisphenol A, bisphenol A ethylene oxide adduct, and bisphenol A propylene oxide adduct.

Preferable examples of tri- or higher-hydric alcohols that can be used to prepare the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of di-basic carboxylic acids that can be used to prepare the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids that can be used to prepare the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

Alternatively, an ester-forming derivative (specific examples include acid halides, acid anhydrides, and lower alkyl esters) of any of the di-, tri-, or higher-basic carboxylic acids listed above may be used. In the present specification, the term "lower alkyl" refers to an alkyl group having a carbon number of 1 to 6.

The acid value and the hydroxyl value of the polyester resin can be adjusted by adjusting the amounts of alcohol and carboxylic acid used in preparation of the polyester resin. An increase in the molecular weight of the polyester resin tends to cause a decrease in the acid value and the hydroxyl value of the polyester resin.

In a situation in which the polyester resin is used as the binder resin, the polyester resin preferably has a number average molecular weight (Mn) of no less than 1,000 and no greater than 2,000 in order to improve toner core strength and toner fixability. The polyester resin preferably has a molecular weight distribution (i.e., a ratio Mw/Mn of mass average molecular weight (Mw) relative to number average molecular weight (Mn)) of no less than 9 and no greater than 21. Mn and Mw of the polyester resin can be measured by gel permeation chromatography.

(Colorant)

The toner cores may contain a colorant. The colorant can be a commonly known pigment or dye that matches the color of the toner. The amount of the colorant is preferably no less than 1 part by mass and no greater than 20 parts by mass relative to 100 parts by mass of the binder resin, and more preferably no less than 3 parts by mass and no greater than 10 parts by mass.

The toner cores may optionally contain a black colorant. The black colorant may for example be carbon black. In another example, the black colorant may be a colorant that is adjusted to a black color using a yellow colorant, a magenta colorant, and a cyan colorant.

The toner cores may optionally contain a non-black colorant such as a yellow colorant, a magenta colorant, or a cyan colorant.

Examples of yellow colorants that can be used include condensed azo compounds, isoindolinone compounds, anthraquinone compounds, azo metal complexes, methine compounds, and arylamide compounds. Preferable examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants that can be used include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants that can be used include copper phthalocyanine, copper phthalocyanine derivatives, anthraquinone compounds, and basic dye lake compounds. Preferable examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner cores may optionally contain a releasing agent. The releasing agent is for example used in order to improve fixability of the toner or resistance of the toner to being offset. In order to improve anionic strength of the toner cores, the toner cores are preferably prepared using an anionic wax. In order to improve toner fixability or offset resistance, the amount of the releasing agent is preferably no less than 1 part by mass and no greater than 30 parts by mass relative to 100 parts by mass of the binder resin, and more preferably no less than 5 parts by mass and no greater than 20 parts by mass.

Preferable examples of releasing agents include aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block polymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester is partially or fully deoxidized such as deoxidized carnauba wax.

In order to improve compatibility between the binder resin and the releasing agent, a compatibilizer may be added to the toner cores.

(Charge Control Agent)

The toner cores may contain a charge control agent. The charge control agent is for example used in order to improve charge stability or a charge rise characteristic of the toner. Anionic strength of the toner cores can be increased by including a negatively chargeable charge control agent in the toner cores. The charge rise characteristic of the toner is an indicator as to whether the toner can be charged to a specific charge level in a short period of time.

(Magnetic Powder)

The toner cores may contain a magnetic powder. Examples of magnetic powders include iron (specific examples include ferrite and magnetite), ferromagnetic metals (specific examples include cobalt and nickel), compounds including either or both of iron and a ferromagnetic metal (specific examples include alloys), ferromagnetic alloys subjected to ferromagnetization (for example, heat treatment), and chromium dioxide.

The magnetic powder is preferably subjected to surface treatment in order to inhibit elution of metal ions (for example, iron ions) from the magnetic powder. In a situation in which shell layers are formed on the surfaces of toner cores under acidic conditions, elution of metal ions to the surfaces of the toner cores causes the toner cores to adhere to one another more readily. Adhesion of the toner cores to one another can be inhibited by inhibiting elution of metal ions from the magnetic powder.

[Shell Layer]

The shell layers include a hydrophilic thermosetting resin and a hydrophobic thermoplastic resin. As a result, shell layers having a uniform thickness are readily formed over the surface of the toner cores. As a result of the shell layers containing the hydrophobic thermoplastic resin in addition to the hydrophilic thermosetting resin, the charge of the toner can be easily adjusted to within a desired range. Note that the shell layers may contain a charge control agent (for example, positively chargeable charge control agent).

As a result of the thermoplastic resin being hydrophobic, the toner is likely to have a structure in which the hydrophobic thermoplastic resin is exposed at the surface of each toner particle as mentioned in the feature (2). As a result of the thermoplastic resin being hydrophobic, the toner is also likely to have a structure in which the blocks substantially composed of the hydrophobic thermoplastic resin are connected to one another via the junction portion substantially composed of the hydrophilic thermosetting resin as mentioned in the feature (3). Consequently, the toner has improved charge retention, and therefore charge decay of the toner is restricted.

The hydrophobic thermoplastic resin is contained in an amount of no less than 0.2% by mass and no greater than 4.7% by mass relative to mass of the toner particles, and preferably in an amount of no less than 0.5% by mass and no greater than 2.7% by mass. The hydrophilic thermosetting resin is contained in an amount of no less than 0.01% by mass and no greater than 0.71% by mass relative to mass of the toner particles, and preferably in an amount of no less than 0.06% by mass and no greater than 0.36% by mass. As a result of the hydrophobic thermoplastic resin content being no less than 0.2% by mass and no greater than 4.7% by mass relative to mass of the toner particles, and the hydrophilic thermosetting resin content being no less than 0.01% by mass and no greater than 0.71% by mass relative to mass of the toner particles, the hydrophobic thermoplastic resin is readily exposed at the surface of each toner particle. Consequently, the toner has improved charge retention, and therefore charge decay of the toner is restricted.

As a result of the hydrophobic thermoplastic resin content being no less than 0.2% by mass relative to mass of the toner particles, the toner has improved high-temperature preservability. As a result of the hydrophobic thermoplastic resin content being no greater than 4.7% by mass relative to mass of the toner particles, the toner has improved low-temperature fixability. As a result of the hydrophilic thermosetting resin content being no less than 0.01% by mass relative to mass of the toner particles, the toner has improved high-temperature preservability. As a result of the hydrophilic thermosetting resin content being no greater than 0.71% by mass relative to mass of the toner particles, the toner has improved low-temperature fixability and charge decay of the toner is particularly restricted.

The hydrophobic thermoplastic resin content in the toner particles can for example be measured by Fourier transform infrared spectroscopy (FT-IR). More specifically, a hydrophobic thermoplastic resin precursor is mixed with the toner cores so that the hydrophobic thermoplastic resin precursor content is 2.5% by mass or 5.0% by mass relative to the total mass of the toner cores and the hydrophobic thermoplastic resin precursor. An infrared absorption spectrum of each of the two mixtures (a mixture having a hydrophobic thermoplastic resin precursor content of 2.5% by mass and a mixture having a hydrophobic thermoplastic resin precursor content of 5.0% by mass) is measured using a Fourier transform infrared spectrophotometer (for example, "Frontier FT IR", product of PerkinElmer Japan Co., Ltd.). An area ratio between a peak resulting from the toner cores and a peak resulting from the hydrophobic thermoplastic resin precursor is calculated based on each infrared absorption spectrum that is obtained. A calibration curve of the hydrophobic thermoplastic resin precursor content is prepared using the thus obtained area ratios and the hydrophobic thermoplastic resin precursor contents (2.5% by mass and 5.0% by mass).

Next, an area ratio between a peak resulting from the toner cores and a peak resulting from the hydrophobic thermoplastic resin precursor of a toner desired to be determined for the hydrophobic thermoplastic resin content is calculated by Fourier transform infrared spectroscopy (FT-IR). The hydrophobic thermoplastic resin content of the toner can be determined from the thus obtained area ratio and the calibration curve prepared as described above.

The hydrophilic thermosetting resin content of the toner particles can for example be measured by organic trace element analysis. More specifically, a hydrophilic thermosetting resin precursor is mixed with the toner cores so that the hydrophilic thermosetting resin precursor content is 0.50% by mass or 1.00% by mass relative to the total mass of the toner cores and the hydrophilic thermosetting resin precursor. A nitrogen content of each of the two mixtures (a mixture having a hydrophilic thermosetting resin precursor content of 0.50% by mass and a mixture having a hydrophilic thermosetting resin precursor content of 1.00% by mass) is measured using an organic trace element analyzer (for example, "2400II", product of PerkinElmer Japan Co., Ltd.). A calibration curve of the hydrophilic thermosetting resin precursor content is prepared using the thus obtained nitrogen contents and the hydrophilic thermosetting resin precursor contents (0.50% by mass and 1.00% by mass).

Next, a nitrogen content of a toner desired to be determined for the hydrophilic thermosetting resin content is measured using the organic trace element analyzer. The hydrophilic thermosetting resin content of the toner can be determined from the thus obtained nitrogen content and the calibration curve prepared as described above.

In the present specification, whether a resin (a thermoplastic resin or a thermosetting resin) is hydrophilic or hydrophobic is determined according to the extent to which the resin has hydrophilic functional groups. A hydrophilic functional group is a functional group capable of forming a salt. Specific examples of hydrophilic functional groups include an amino group (—$NH_2$, =NH, or =N—), an acid group (carboxyl group), and a hydroxyl group. In the present specification, for example, a resin in which mass of a repeating unit having a hydrophilic functional group is greater than 10% by mass relative to the total mass of the resin is defined as a hydrophilic resin. In the present specification, for example, a resin in which mass of a repeating unit having a hydrophilic functional group is no greater than 10% by mass relative to the total mass of the resin is defined as a hydrophobic resin.

The hydrophobic thermoplastic resin preferably has a functional group (for example, a hydroxyl group, a carboxyl group, an amino group, a carbodiimide group, an oxazoline group, or a glycidyl group) that is reactive with a functional group of the hydrophilic thermosetting resin (for example, a methylol group or an amino group). The amino group may be included in the hydrophobic thermoplastic resin in the form of a carbamoyl group (—$CONH_2$). The hydrophobic thermoplastic resin preferably has a glass transition point (Tg) of no less than 45° C. and no greater than 100° C., and more preferably no less than 68° C. and no greater than 90° C. in order to improve high-temperature preservability. Tg of the hydrophobic thermoplastic resin can for example be measured using a differential scanning calorimeter. More specifically, Tg of the hydrophobic thermoplastic resin can be obtained from a point of change of specific heat on a heat absorption curve that is plotted by measuring a sample (the hydrophobic thermoplastic resin) using the differential scanning calorimeter.

In order to improve film quality of the shell layers, a monomer for forming the hydrophobic thermoplastic resin preferably contains an acrylic acid-based monomer, more preferably a reactive acrylate, and particularly preferably HEMA (2-hydroxyethyl methacrylate).

Specific examples of hydrophobic thermoplastic resins that can be used include styrene-based polymers, acrylic acid-based polymers, styrene-acrylic acid-based copolymers, silicone-acrylic acid-based graft copolymers, urethane resins, polyester resins, and ethylene vinyl alcohol copolymers. The hydrophobic thermoplastic resin is preferably a styrene-based polymer, an acrylic acid-based polymer, a styrene-acrylic acid-based copolymer, or a silicone-acrylic acid-based graft copolymer, and is more preferably a styrene-based polymer or a styrene-acrylic acid-based copolymer. The hydrophobic thermoplastic resin is preferably a nitrogen-free hydrophobic thermoplastic resin.

The styrene-based polymer is obtained through polymerization of a styrene-based monomer. The styrene-acrylic acid-based copolymer is obtained through copolymerization of a styrene-based monomer and an acrylic acid-based monomer.

Examples of styrene-based monomers that can be used to introduce a hydrophobic thermoplastic resin to the shell layers are the same as the preferable examples of styrene-based monomers listed with respect to the binder resin. In order that the thermoplastic resin is highly hydrophobic, the styrene-based monomer is preferably styrene.

Examples of acrylic acid-based monomers that can be used to introduce a hydrophobic thermoplastic resin into the shell layers include: alkyl (meth)acrylates such as methyl (meth)acrylate, ethyl (meth)acrylate, n-propyl (meth)acrylate, and n-butyl (meth)acrylate; aryl (meth)acrylates such as phenyl (meth)acrylate; hydroxyalkyl (meth)acrylates such as 2-hydroxyethyl (meth)acrylate, 3-hydroxypropyl (meth) acrylate, 2-hydroxypropyl (meth)acrylate, and 4-hydroxybutyl (meth)acrylate; (meth)acrylamide; (meth)acrylic acid ethylene oxide adduct; and alkyl ethers (for example, methyl ether, ethyl ether, n-propyl ether, or n-butyl ether) of ethylene oxide adduct of a (meth)acrylic acid ester. In order that the thermoplastic resin is highly hydrophobic, the acrylic acid-based monomer is preferably an alkyl (meth)acrylate.

Preferable examples of the hydrophilic thermosetting resin include melamine resins, urea resins, sulfonamide resins, glyoxal resins, guanamine resins, aniline resins, polyimide resins, and derivatives of any of the aforementioned resins. A polyimide resin includes nitrogen atoms in a molecular backbone thereof. Therefore, shell layers containing a polyimide resin tend to be strongly cationic. Examples of polyimide resins that can be used include maleimide-based polymers and bismaleimide-based polymers (specific examples include amino-bismaleimide polymer and bismaleimide-triazine polymer).

A resin produced through polycondensation of a compound having an amino group and an aldehyde (for example, formaldehyde) is preferable as the hydrophilic thermosetting resin. More preferably, the hydrophilic thermosetting resin is one or more resins selected from the group consisting of a melamine resin, a urea resin, and a glyoxal resin. A melamine resin is a polycondensate of melamine and formaldehyde. A urea resin is a polycondensate of urea and formaldehyde. A glyoxal resin is a polycondensate of formaldehyde and a reaction product of glyoxal and urea.

The hydrophilic thermosetting resin is preferably a nitrogen-containing hydrophilic thermosetting resin. Cross-link curing by the hydrophilic thermosetting resin can be improved through inclusion of nitrogen atoms in the hydrophilic thermosetting resin. In order to increase reactivity of the hydrophilic thermosetting resin, the nitrogen content of the hydrophilic thermosetting resin is preferably adjusted to no less than 40% by mass and no greater than 55% by mass in the case of a melamine resin. In the case of a urea resin, the nitrogen content of the hydrophilic thermosetting resin is preferably adjusted to approximately 40% by mass. In the case of a glyoxal resin, the nitrogen content of the hydrophilic thermosetting resin is preferably adjusted to approximately 15% by mass.

Examples of monomers that can be used to introduce the hydrophilic thermosetting resin into the shell layers include methylol melamine, benzoguanamine, acetoguanamine, spiroguanamine, and dimethylol dihydroxyethyleneurea (DMDHEU).

The shell layers may have fractures (i.e., portions having low mechanical strength) therein. The fractures can for example be formed by causing localized defects to occur in the shell layers. Formation of the fractures in the shell layers enables the shell layers to be ruptured more easily. As a result, the toner can be fixed to a recording medium at low temperatures. Any appropriate number of fractures may be provided.

[External Additive]

An external additive may optionally be caused to adhere to the surface of the toner particles as necessary. Examples of external additives that can be used include fine particles of metal oxides (specific examples include alumina, titanium oxide, magnesium oxide, zinc oxide, strontium titanate, and barium titanate) and fine particles of silica.

The external additive preferably has a particle size of no less than 0.01 μm and no greater than 1.0 μm. The amount of the external additive is preferably no less than 0.5 parts by mass and no greater than 10 parts by mass relative to 100 parts by mass of the toner mother particles, and more preferably no less than 1 part by mass and no greater than 5 parts by mass.

The toner according to the present embodiment can be mixed with a desired carrier to prepare a two-component developer. A magnetic carrier is preferably used in preparation of the two-component developer.

One preferable example of a carrier is a carrier in which carrier cores are coated by a resin. Specific examples of the carrier cores include: particles of iron, oxidized iron, reduced iron, magnetite, copper, silicon steel, ferrite, nickel, or cobalt; particles of an alloy of any of the above materials with a metal such as manganese, zinc, or aluminum; particles of iron-nickel alloy or iron-cobalt alloy, particles of a ceramic (specific examples include titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate); and particles of a high-dielectric substance (specific examples include ammonium dihydrogen phosphate, potassium dihydrogen phosphate, and Rochelle salt). The carrier may be a resin carrier prepared by dispersing any of the particles listed above in a resin.

Examples of resins that can be used to coat the carrier cores include acrylic acid-based polymers, styrene-based polymers, styrene-acrylic acid-based copolymers, olefin polymers (specific examples include polyethylene, chlorinated polyethylene, and polypropylene), polyvinyl chloride, polyvinyl acetate, polycarbonate resins, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resins, and amino resins. Two or more of the resins listed above may be used in a combination.

The carrier preferably has a particle size, as measured using an electron microscope, of no less than 20 μm and no greater than 120 μm, and more preferably no less than 25 μm and no greater than 80 μm.

In a situation in which the toner and the carrier are used to prepare a two-component developer, the amount of the toner is preferably no less than 3% by mass and no greater than 20% by mass relative to mass of the two-component developer, and more preferably no less than 5% by mass and no greater than 15% by mass.

[Toner Manufacturing Method]

The following describes a method for manufacturing the toner according to the present embodiment. The method for manufacturing the toner according to the present embodiment includes a toner core production process and a shell layer formation process. The toner core production process involves producing toner cores. The shell layer formation process involves adding the toner cores produced through the toner core production process, a hydrophilic thermosetting resin precursor, and a hydrophobic thermoplastic resin precursor to an aqueous medium, and causing the hydrophobic thermoplastic resin precursor to adhere to the surface of each of the toner cores in the aqueous medium. The shell layer formation process also involves heating the aqueous medium to form a shell layer containing a hydrophilic thermosetting resin and a hydrophobic thermoplastic resin on the surface of each of the toner cores.

(Toner Core Production Process)

Examples of preferable toner core production processes include a pulverization method and an aggregation method.

In the pulverization method, a binder resin and internal additives (for example, a colorant, a releasing agent, a charge control agent, and a magnetic powder) are mixed. Next, the resultant mixture is melted and kneaded. The resultant kneaded product is subsequently pulverized. Next, the resultant pulverized product is classified. As a result, toner cores having a desired particle size are produced. The pulverization method enables relatively simple production of toner cores.

The aggregation method for example includes an aggregation step and a coalescence step. The aggregation step involves causing fine particles containing components of the toner cores to aggregate in an aqueous medium to form aggregated particles. The coalescence step involves causing coalescence of the components contained in the aggregated particles in the aqueous medium to form toner cores. The aggregation method enables production of toner cores that tend to be uniform in shape and particle size.

(Shell Layer Formation Process)

The shell layer formation process involves forming shell layers on the surfaces of the toner cores. The shell layers are formed using a hydrophilic thermosetting resin precursor and a hydrophobic thermoplastic resin precursor. Formation of the shell layers is preferably carried out in an aqueous medium in order to prevent dissolution of the binder resin or elution of the releasing agent. In the method for manufacturing the toner according to the present embodiment, the toner cores produced through the toner core production process, a hydrophilic thermosetting resin precursor, and a hydrophobic thermoplastic resin precursor are added to an aqueous medium.

The aqueous medium is a medium in which water is a main component. The aqueous medium may function as a solution medium or a dispersion medium. Specific examples of the aqueous medium include water (for example, ion exchanged water) and a mixture of water and a polar solvent. Examples of the polar solvent included in the aqueous medium include methanol and ethanol. The water content of the aqueous medium is preferably no less than 70% by mass relative to mass of the aqueous medium, more preferably no less than 80% by mass, still more preferably no less than 90% by mass, and most preferably 100% by mass.

Figure 6:
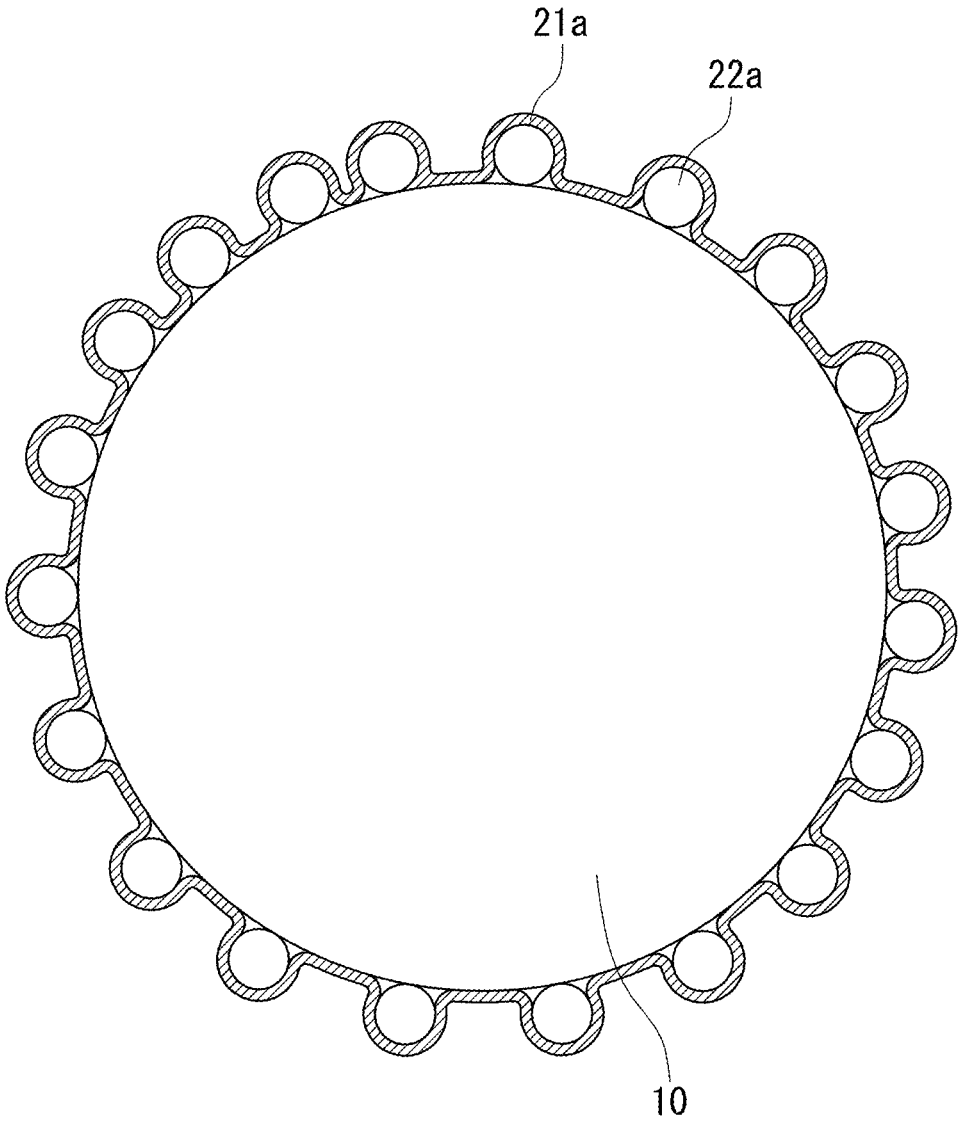
FIG. 6 is a diagram illustrating a toner core having a hydrophobic thermoplastic resin precursor adhering to a surface thereof in the toner according to the embodiment of the present disclosure.
Figure 7:
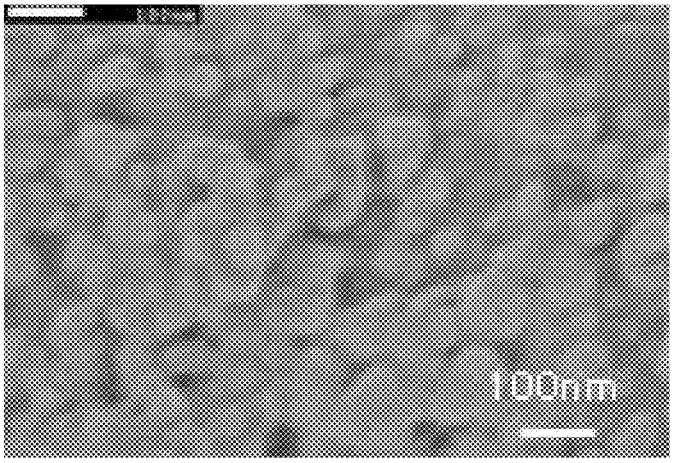
FIG. 7 is an SEM photograph showing a structure of a shell layer including a hydrophobic thermoplastic resin precursor adhering to a surface of a toner core in the toner according to the embodiment of the present disclosure.
Figure 8:
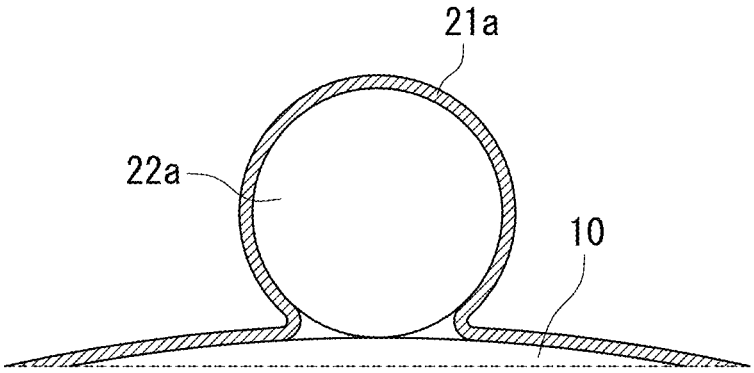
FIG. 8 is an enlarged view of part of a surface of a toner core in the toner according to the embodiment of the present disclosure.

The following explains the shell layer formation process with reference mainly to FIGS. 6 to 8. FIG. 6 illustrates the toner core 10 having the hydrophobic thermoplastic resin precursor adhering to the surface thereof in a method for manufacturing a toner according to the present embodiment.

As a result of addition of the toner cores 10 and the shell materials (the hydrophilic thermosetting resin precursor and the hydrophobic thermoplastic resin precursor) to an aqueous medium, the particulate hydrophobic thermoplastic resin precursor (particles 22*a* of the hydrophobic thermoplastic resin precursor) comes adsorbed to the surfaces of the toner cores 10 in the aqueous medium. Thus, the particles 22*a* of the hydrophobic thermoplastic resin precursor adhere to the surfaces of the toner cores 10 in the aqueous medium. A film 21*a* of the hydrophilic thermosetting resin precursor is formed to cover the surface of each of the toner cores 10 having the particles 22*a* of the hydrophobic thermoplastic resin precursor adhering thereto. More specifically, the film 21*a* of the hydrophilic thermosetting resin precursor and the particles 22*a* of the hydrophobic thermoplastic resin precursor are formed on the surface of each toner core 10 as illustrated in FIG. 6. The film 21*a* and the particles 22*a* each adhere to the surface of the toner core 10. The hydrophobic thermoplastic resin precursor is thought to aggregate to form the particles 22*a*, rather than spreading out in the aqueous medium, due to the hydrophobicity of the precursor.

FIG. 7 is an SEM photograph showing the structure of the shell layer 20 including the hydrophobic thermoplastic resin precursor adhering to the surface of the toner core 10. FIG. 7 is an SEM photograph captured at a magnification of ×100,000. The particles 22*a* adhering to the surface of the toner core 10 and the film 21*a* covering the particles 22*a* and the toner core 10 are observed in the SEM photograph. FIG. 8 is an enlarged view of part of the surface of the toner core 10. Since the particles 22*a* are hydrophobic, it is thought that each of the particles 22*a* is enclosed by the toner core 10 and the film 21*a* to be prevented from being exposed to the aqueous medium as illustrated in FIG. 8.

After the toner cores 10, the hydrophilic thermosetting resin precursor, and the hydrophobic thermoplastic resin precursor are added to the aqueous medium, the aqueous medium (more specifically, a dispersion of the toner cores 10 each having the film 21*a* and the particles 22*a* formed thereon) is heated up to a specified temperature under stirring, and then maintained at the specified temperature for a specified period of time. Through the above, curing of the shell materials (hydrophilic thermosetting resin precursor and hydrophobic thermoplastic resin precursor) adhering to the surface of each of the toner cores 10 occurs through a polymerization reaction. As a result, the shell layer 20 including the hydrophilic thermosetting resin and the hydrophobic thermoplastic resin is formed on the surface of each of the toner cores 10. Thus, a dispersion of toner mother particles is obtained. In order to improve high-temperature preservability, the hydrophobic thermoplastic resin precursor upon being added to the aqueous medium preferably has a number average particle size of no greater than 80 μm, and more preferably no less than 30 μm and no greater than 80 μm.

The shell materials (hydrophobic thermoplastic resin precursor and hydrophilic thermosetting resin precursor) adhere to the toner cores 10 prior to curing of the shell layers 20. It is thought that, as a result of the above, the particles 22*a* of the hydrophobic thermoplastic resin precursor do not fuse with one another at the surfaces of the toner cores 10, even when the shell layers 20 are cured by heating. Furthermore, it is thought that the hydrophilic thermosetting resin precursor is present at an interface between the aqueous medium and each particle 22*a* of the hydrophobic thermoplastic resin precursor due to strong hydrophilicity of the hydrophilic thermosetting resin precursor prior to heating. However, hydrophilicity of the hydrophilic thermosetting resin precursor tends to weaken as the curing reaction of the shell layers 20 proceeds. The above is thought to cause the hydrophilic thermosetting resin precursor to move into gaps between the blocks 22 of the hydrophobic thermoplastic resin and gaps between the blocks 22 of the hydrophobic thermoplastic resin and the toner cores 10 during the curing reaction of the shell layers 20 as a result of the capillary effect. As a result, the structure described as the feature (2) in which the hydrophobic thermoplastic resin is exposed at the surface of the toner particle 30 is formed. Furthermore, the structure described as the feature (3) in which the blocks 22 substantially composed of the hydrophobic thermoplastic resin are connected to one another via the junction portion 21 substantially composed of the hydrophilic thermosetting resin is formed.

Good dispersion of the toner cores 10 in the aqueous medium is for example achieved through mechanical dispersion using a device capable of vigorously stirring the liquid dispersion.

The pH of the aqueous medium is preferably adjusted to approximately 4 using an acidic substance prior to addition of the materials for forming the shell layers 20. Adjustment of the aqueous medium to an acidic pH promotes the polymerization reaction by which the shell layers 20 are formed.

In order that formation of the shell layers 20 proceeds favorably, the shell layers 20 are preferably formed on the surfaces of the toner cores 10 at a temperature of no less than 40° C. and no greater than 95° C., and more preferably no less than 50° C. and no greater than 80° C.

After the formation of the shell layers 20 as described above, the dispersion of the toner mother particles is cooled to room temperature. Thereafter, toner is collected from the dispersion of the toner mother particles by carrying out, as necessary, a step of washing the toner mother particles (washing step), a step of drying the toner mother particles (drying step), and a step of causing an external additive to adhere to the surfaces of the toner mother particles (external addition step).

The washing step involves washing the toner mother particles using water. Preferable washing methods include: a method involving collecting a wet cake of the toner mother particles from the dispersion of toner mother particles by solid-liquid separation and washing the collected wet cake of toner mother particles using water; and a method involving causing sedimentation of the toner mother particles in the dispersion, exchanging a supernatant with water, and subsequently re-dispersing the toner mother particles in the water.

The drying step involves drying the toner mother particles. Preferable examples of methods for drying the toner mother particles include use of a dryer (for example, a spray dryer, a fluidized bed dryer, a vacuum freeze dryer, or a reduced pressure dryer). In particular, use of a spray dryer is preferable in terms of inhibiting aggregation of the toner mother particles during drying. The spray dryer can be used to cause an external additive, such as silica, to adhere to the surfaces of the toner mother particles by spraying a dispersion of the external additive with a dispersion of the toner mother particles.

The external addition step involves causing an external additive to adhere to the surfaces of the toner mother particles. Preferable examples of methods for causing adhesion of the external additive include a method involving using a mixer (for example, an FM mixer and a Nauta mixer (registered Japanese trademark)) to mix the toner mother particles and the external additive under conditions such that the external additive does not become embedded in the surfaces of the toner mother particles.

The toner manufacturing method described above may be altered as appropriate in accordance with requirements of the toner, such as in terms of composition and properties. For example, the shell materials may be dissolved in a solvent prior to addition of the toner cores 10 to the solvent. Alternatively, the toner cores 10 may be added to a solvent prior to dissolving the shell materials in the solvent. The shell layers 20 may be formed by any appropriate process. The shell layers 20 may for example be formed through any of an in-situ polymerization process, an in-liquid curing coating process, or a coacervation process. Various steps may be omitted as appropriate depending on the intended use of the toner. In a situation in which an external additive is not caused to adhere to the surfaces of the toner mother particles (i.e., the external addition step is omitted), the toner mother particles and the toner particles 30 are equivalent. In order to efficiently manufacture the toner, preferably a large number of toner particles 30 are formed at the same time.

So far, the shell layer formation process has been described with reference mainly to FIGS. 6 to 8.

According to the toner of the present embodiment, it is possible to improve high-temperature preservability and low-temperature fixability of the toner and to restrict charge decay of the toner. According to the toner manufacturing method of the present embodiment, it is possible to manufacture a toner which is excellent in high-temperature preservability and low-temperature fixability and in which charge decay can be restricted.

EXAMPLES (Preparation of Suspension of First Shell Resin Precursor I)

First, 815 mL of ion exchanged water and 75 mL of an anionic surfactant (LATEMUL (registered Japanese trademark) WX, product of Kao Corporation, sodium polyoxyethylene alkyl ether sulfate) were added into a 1-L three-necked flask equipped with a thermometer and a stirring impeller. The internal temperature of the flask was subsequently increased to 80° C. using a water bath. Thereafter, a mixture of 68 mL of styrene and 12 mL of butyl acrylate, and, separately thereto, a solution of 0.5 g of potassium persulfate dissolved in 30 mL of ion exchanged water were dripped into the flask over 5 hours. The flask contents were maintained at 80° C. for 2 hours to complete polymerization. Through the above, a suspension of a first shell resin precursor I (solid concentration: 8% by mass) was prepared. The first shell resin precursor I was observed using a transmission electron microscope to confirm that the number average particle size thereof was 32 nm. Tg of the first shell resin precursor I was measured using a differential scanning calorimeter to be 72° C. The first shell resin precursor I was a precursor of a hydrophobic thermoplastic resin.

(Preparation of Suspension of First Shell Resin Precursor II)

A suspension of a first shell resin precursor II (solid concentration: 8% by mass) was prepared in the same manner as for the first shell resin precursor I except that the amount of the anionic surfactant was changed from 75 mL to 25 mL. The thus obtained first shell resin precursor II was observed using a transmission electron microscope to confirm that the number average particle size thereof was 107 nm. Tg of the first shell resin precursor II was measured using a differential scanning calorimeter to be 68° C. The first shell resin precursor II was a precursor of a hydrophobic thermoplastic resin.

(Preparation of Suspension of First Shell Resin Precursor III)

A suspension of a first shell resin precursor III (solid concentration: 8% by mass) was prepared in the same manner as for the first shell resin precursor I except that butyl acrylate was not added and the amount of styrene was changed from 68 mL to 80 mL. The thus obtained first shell resin precursor III was observed using a transmission electron microscope to confirm that the number average particle size thereof was 30 nm. Tg of the first shell resin precursor III was measured using a differential scanning calorimeter to be 103° C. The first shell resin precursor III was a precursor of a hydrophobic thermoplastic resin.

(Preparation of Suspension of First Shell Resin Precursor IV)

A suspension of a first shell resin precursor IV (solid concentration: 8% by mass) was prepared in the same manner as for the first shell resin precursor I except that the amount of the anionic surfactant was changed from 75 mL to 35 mL. The thus obtained first shell resin precursor IV was observed using a transmission electron microscope to confirm that the number average particle size thereof was 77 nm. Tg of the first shell resin precursor IV was measured using a differential scanning calorimeter to be 69° C. The first shell resin precursor IV was a precursor of a hydrophobic thermoplastic resin.

(Preparation of Suspension of First Shell Resin Precursor V)

A suspension of a first shell resin precursor V (solid concentration: 8% by mass) was prepared in the same manner as for the first shell resin precursor I except that the amount of styrene was changed from 68 mL to 74 mL, and the amount of butyl acrylate was changed from 12 mL to 6 mL. The thus obtained first shell resin precursor V was observed using a transmission electron microscope to confirm that the number average particle size thereof was 30 nm. Tg of the first shell resin precursor V was measured using a differential scanning calorimeter to be 90° C. The first shell resin precursor V was a precursor of a hydrophobic thermoplastic resin.

(Preparation of Suspension of First Shell Resin Precursor VI)

A suspension of a first shell resin precursor VI (solid concentration: 8% by mass) was prepared in the same manner as for the first shell resin precursor I except that butyl acrylate was not added, the amount of styrene was changed from 68 mL to 75 mL, and 5 mL of divinylbenzene was added together with styrene. The thus obtained first shell resin precursor VI was observed using a transmission electron microscope to confirm that the number average particle size thereof was 30 nm. Tg of the first shell resin precursor VI was measured using a differential scanning calorimeter to be immeasurable. It is therefore inferred that the first shell resin precursor VI was a crosslinking thermosetting resin. The first shell resin precursor VI was hydrophobic.

Example 1

(Toner Core Preparation)

An FM mixer (product of Nippon Coke & Engineering Co., Ltd.) was used to mix 750 g of a low viscosity polyester resin (Tg=38° C., Tm=65° C.), 100 g of a medium viscosity polyester resin (Tg=53° C., Tm=84° C.), 150 g of a high viscosity polyester resin (Tg=71° C., Tm=120° C.), 55 g of a releasing agent (carnauba wax, "Carnauba Wax No. 1", product of S. Kato & Co.), and 40 g of a colorant (Phthalocyanine Blue, "KET Blue 111", product of DIC Corporation) at a stirring rate of 2,400 rpm. The resultant mixture was melt-kneaded using a twin-screw extruder ("PCM-30", product of Ikegai Corp.) under conditions of a material input rate of 5 kg/hour, a shaft rotational speed of 160 rpm, and a temperature setting range of 100° C. to 130° C. The resultant kneaded product was cooled and then coarsely pulverized using a pulverizer ("Rotoplex (registered Japanese trademark) 16/8", product of Hosokawa Micron Corporation). Next, the coarsely pulverized product was finely pulverized using a jet mill ("Model-I Supersonic Jet Mill", product of Nippon Pneumatic Mfg. Co., Ltd.). Thereafter, the finely pulverized product was classified using a classifier ("Elbow Jet EJ-LABO", product of Nittetsu Mining Co., Ltd.). As a result, toner cores were obtained.

(Shell Layer Formation Process)

First, 300 mL of ion exchanged water was added into a 1-L three-necked flask equipped with a thermometer and a stirring impeller. The internal temperature of the flask was subsequently maintained at 30° C. using a water bath. Next, dilute hydrochloric acid was added into the flask to adjust the pH of an aqueous medium in the flask to 4. After pH adjustment, a first shell resin precursor and a second shell resin precursor were added into the flask as raw materials for shell layers. As the first shell resin precursor, 75 mL of the suspension of the first shell resin precursor I was added. As the second shell resin precursor, 0.8 mL of an aqueous solution of a hexamethylol melamine prepolymer ("MIRBANE (registered Japanese trademark) resin SM-607", product of Showa Denko K.K., solid concentration: 80% by mass) was added. The hexamethylol melamine prepolymer is a precursor of a hydrophilic thermosetting resin. The shell layer raw materials were dissolved in the aqueous medium to prepare an aqueous solution (A) of the shell layer raw materials. Next, 300 g of the toner cores were added to the aqueous solution (A). Thereafter, the flask contents were stirred for 1 hour at a stirring rate of 200 rpm. Next, 300 mL of ion exchanged water was added into the flask. Thereafter, the internal temperature of the flask was increased to 70° C. at a rate of 1° C./minute while stirring the flask contents at a stirring rate of 100 rpm. After heating, the flask contents were stirred continuously for 2 hours at 70° C. at a stirring rate of 100 rpm. Thereafter, sodium hydroxide was added into the flask to adjust the pH of the flask contents to 7. Next, the flask contents were cooled to room temperature to yield a toner mother particle-containing dispersion.

(Washing Step)

A wet cake of toner mother particles was collected from the toner mother particle-containing dispersion using a Buchner funnel. The toner mother particles were then washed by re-dispersing the wet cake of the toner mother particles in ion exchanged water. The toner mother particles were washed five times with ion exchanged water as described above.

(Drying Step)

A slurry was prepared by dispersing the washed wet cake of the toner mother particles in 50% by mass concentration aqueous ethanol solution. The prepared slurry was fed into a continuous type surface modifier ("Coatmizer (registered Japanese trademark)", product of Freund Corporation) to dry the toner mother particles in the slurry, yielding dry toner mother particles. Drying was carried out at a hot air temperature of 45° C. and a flow rate of 2 $m^3$/minute.

(External Addition Step)

An FM mixer (product of Nippon Coke & Engineering Co., Ltd.) having a capacity of 10 L was used to mix 100 parts by mass of the toner mother particles resulting from the drying step and 1.0 parts by mass of dry silica ("REA90", product of Nippon Aerosil Co., Ltd.) for 5 minutes to cause the external additive to adhere to the surfaces of the toner mother particles. Thereafter, the resultant toner was sifted using a 200 mesh (opening: 75 μm) sieve to yield a toner of Example 1.

Example 2

A toner of Example 2 was prepared in the same manner as in Example 1 except that 75 mL of the suspension of the first shell resin precursor II was added instead of 75 mL of the suspension of the first shell resin precursor I in the shell layer formation process.

Example 3

A toner of Example 3 was prepared in the same manner as in Example 1 except that 75 mL of the suspension of the first shell resin precursor III was added instead of 75 mL of the suspension of the first shell resin precursor I in the shell layer formation process.

Example 4

A toner of Example 4 was prepared in the same manner as in Example 1 except that the amount of the aqueous solution of the hexamethylol melamine prepolymer added as the second shell resin precursor was changed from 0.8 mL to 0.25 mL in the shell layer formation process.

Example 5

A toner of Example 5 was prepared in the same manner as in Example 1 except that the amount of the aqueous solution of the hexamethylol melamine prepolymer added as the second shell resin precursor was changed from 0.8 mL to 1.3 mL in the shell layer formation process.

Example 6

A toner of Example 6 was prepared in the same manner as in Example 1 except that the amount of the suspension of the first shell resin precursor I was changed from 75 mL to 20 mL in the shell layer formation process.

Example 7

A toner of Example 7 was prepared in the same manner as in Example 1 except that the amount of the suspension of the first shell resin precursor I was changed from 75 mL to 110 mL in the shell layer formation process.

Example 8

A toner of Example 8 was prepared in the same manner as in Example 1 except that the amount of the aqueous solution of the hexamethylol melamine prepolymer added as the second shell resin precursor was changed from 0.8 mL to 0.025 mL in the shell layer formation process.

Example 9

A toner of Example 9 was prepared in the same manner as in Example 1 except that the amount of the aqueous solution of the hexamethylol melamine prepolymer added as the second shell resin precursor was changed from 0.8 mL to 2.5 mL in the shell layer formation process.

Example 10

A toner of Example 10 was prepared in the same manner as in Example 1 except that the amount of the suspension of the first shell resin precursor I was changed from 75 mL to 9 mL in the shell layer formation process.

Example 11

A toner of Example 11 was prepared in the same manner as in Example 1 except that the amount of the suspension of the first shell resin precursor I was changed from 75 mL to 185 mL in the shell layer formation process.

Example 12

A toner of Example 12 was prepared in the same manner as in Example 1 except that 75 mL of the suspension of the first shell resin precursor IV was added instead of 75 mL of the suspension of the first shell resin precursor I in the shell layer formation process.

Example 13

A toner of Example 13 was prepared in the same manner as in Example 1 except that 75 mL of the suspension of the first shell resin precursor V was added instead of 75 mL of the suspension of the first shell resin precursor I in the shell layer formation process.

Comparative Example 1

A toner of Comparative Example 1 was prepared in the same manner as in Example 1 except that 27 mL of an aqueous solution of a first shell resin precursor VII ("BECKAMINE (registered Japanese trademark) A-1", water-soluble polyacrylamide, product of DIC Corporation, solid concentration: 11% by mass) was added instead of 75 mL of the suspension of the first shell resin precursor I in the shell layer formation process. The first shell resin precursor VII was a hydrophilic thermoplastic resin precursor.

Comparative Example 2

A toner of Comparative Example 2 was prepared in the same manner as in Example 1 except that 75 mL of the suspension of the first shell resin precursor VI was added instead of 75 mL of the suspension of the first shell resin precursor I in the shell layer formation process.

Comparative Example 3

A toner of Comparative Example 3 was prepared in the same manner as in Example 1 except that the aqueous solution of the hexamethylol melamine prepolymer as the second shell resin precursor was not added in the shell layer formation process.

Comparative Example 4

A toner of Comparative Example 4 was prepared in the same manner as in Example 1 except that the amount of the aqueous solution of the hexamethylol melamine prepolymer added as the second shell resin precursor was changed from 0.8 mL to 3 mL in the shell layer formation process.

Comparative Example 5

A toner of Comparative Example 5 was prepared in the same manner as in Example 1 except that the amount of the suspension of the first shell resin precursor I was changed from 75 mL to 4 mL in the shell layer formation process.

Comparative Example 6

A toner of Comparative Example 6 was prepared in the same manner as in Example 1 except that the amount of the suspension of the first shell resin precursor I was changed from 75 mL to 200 mL in the shell layer formation process.

[Measurement Method]

(First Shell Resin Content)

The first shell resin content was determined using a calibration curve. Specifically, the first shell resin precursor I was mixed with the toner cores prepared in Example 1 so that the first shell resin precursor I content was 2.5% by mass or 5.0% by mass relative to the total mass of the toner cores and the first shell resin precursor I. More specifically, 97.5 parts by mass of the toner cores and 2.5 parts by mass of the first shell resin precursor I were mixed. Separately thereto, 95.0 parts by mass of the toner cores and 5.0 parts by mass of the first shell resin precursor I were mixed. An infrared absorption spectrum of each of the two mixtures (a mixture having a first shell resin precursor I content of 2.5% by mass and a mixture having a first shell resin precursor I content of 5.0% by mass) was measured using a Fourier transform infrared spectrophotometer ("Frontier FT IR", product of PerkinElmer Japan Co., Ltd.). An area ratio between a peak resulting from the toner cores and a peak resulting from the first shell resin precursor I was calculated based on each spectrum that is obtained. A calibration curve of area ratio versus first shell resin precursor I content (2.5% by mass and 5.0% by mass) was prepared using the thus obtained area ratios and the first shell resin precursor I contents.

Next, an area ratio between a peak resulting from the toner cores of the toner of Example 1 and a peak resulting from the hydrophobic thermoplastic resin precursor was obtained using the Fourier transform infrared spectrophotometer. The first shell resin I content of the toner of Example 1 was determined according to the calibration curve prepared as described above. A calibration curve was prepared for each of the first shell resin precursors II to VII in the same manner as for the first shell resin precursor I, and the first shell resin content of each of the toners of Examples 2 to 13 and Comparative Examples 1 to 6 was determined.

(Second Shell Resin Content)

The second shell resin content was determined using a calibration curve. Specifically, the second shell resin precursor (an aqueous solution of hexamethylol melamine prepolymer, "MIRBANE (registered Japanese trademark) resin SM-607", product of Showa Denko K.K., solid concentration: 80% by mass) was mixed with the toner cores prepared in Example 1 so that the content of the aqueous solution of the hexamethylol melamine prepolymer as the second shell resin precursor was 0.50% by mass or 1.00% by mass relative to the total mass of the toner cores and the second shell resin precursor. More specifically, 99.50 parts by mass of the toner cores and 0.50 parts by mass of the second shell resin precursor were mixed. Separately thereto, 99.00 parts by mass of the toner cores and 1.00 part by mass of the second shell resin precursor were mixed. A nitrogen content of each of the two mixtures (a mixture having a second shell resin precursor content of 0.50% by mass and a mixture having a second shell resin precursor content of 1.00% by mass) was measured using an organic trace element analyzer ("2400II", product of PerkinElmer Japan Co., Ltd.). A calibration curve of the second shell resin precursor content was prepared using the thus obtained nitrogen contents and the second shell resin precursor contents (0.50% by mass and 1.00% by mass).

Next, a nitrogen content of each of the toners of Examples 1 to 13 and Comparative Examples 1 to 6 was measured using the organic trace element analyzer ("2400II", product of PerkinElmer Japan Co., Ltd.). A second shell resin content of each of the toners of Examples 1 to 13 and Comparative Examples 1 to 6 was determined according to the calibration curve prepared as described above.

Table 1 shows the first shell resin precursors and the second shell resin precursors used for the preparation of the toners of Examples 1 to 13 and Comparative Examples 1 to 6.

TABLE 1

| | First shell resin precursor | | | | | | First shell resin | Second shell resin precursor | Second shell resin |
|---|---|---|---|---|---|---|---|---|---|
| | Type | Hydrophobic/ Hydrophilic | Thermoplastic/ Thermosetting | Particle size (nm) | Tg (° C.) | Amount (mL) | Content (% by mass) | Amount (mL) | Content (% by mass) |
| Example 1 | I | Hydrophobic | Thermoplastic | 32 | 72 | 75 | 1.9 | 0.8 | 0.22 |
| Example 2 | II | Hydrophobic | Thermoplastic | 107 | 68 | 75 | 1.7 | 0.8 | 0.20 |
| Example 3 | III | Hydrophobic | Thermoplastic | 30 | 103 | 75 | 1.9 | 0.8 | 0.21 |
| Example 4 | I | Hydrophobic | Thermoplastic | 32 | 72 | 75 | 1.9 | 0.25 | 0.06 |
| Example 5 | I | Hydrophobic | Thermoplastic | 32 | 72 | 75 | 2.0 | 1.3 | 0.36 |
| Example 6 | I | Hydrophobic | Thermoplastic | 32 | 72 | 20 | 0.5 | 0.8 | 0.20 |
| Example 7 | I | Hydrophobic | Thermoplastic | 32 | 72 | 110 | 2.7 | 0.8 | 0.21 |
| Example 8 | I | Hydrophobic | Thermoplastic | 32 | 72 | 75 | 1.8 | 0.025 | 0.01 |
| Example 9 | I | Hydrophobic | Thermoplastic | 32 | 72 | 75 | 1.9 | 2.5 | 0.71 |
| Example 10 | I | Hydrophobic | Thermoplastic | 32 | 72 | 9 | 0.2 | 0.8 | 0.19 |
| Example 11 | I | Hydrophobic | Thermoplastic | 32 | 72 | 185 | 4.7 | 0.8 | 0.23 |
| Example 12 | IV | Hydrophobic | Thermoplastic | 77 | 69 | 75 | 1.9 | 0.8 | 0.20 |
| Example 13 | V | Hydrophobic | Thermoplastic | 30 | 90 | 75 | 1.8 | 0.8 | 0.21 |
| Comparative Example 1 | VI | Hydrophilic | Thermoplastic | — | 66 | 27 | 1.8 | 0.8 | 0.20 |
| Comparative Example 2 | VI | Hydrophobic | Thermosetting | 30 | Cross-linking | 75 | 2.0 | 0.8 | 0.22 |
| Comparative Example 3 | I | Hydrophobic | Thermoplastic | 32 | 72 | 75 | 1.6 | — | — |
| Comparative Example 4 | I | Hydrophobic | Thermoplastic | 32 | 72 | 75 | 2.0 | 3 | 0.85 |
| Comparative Example 5 | I | Hydrophobic | Thermoplastic | 32 | 72 | 4 | 0.1 | 0.8 | 0.18 |
| Comparative Example 6 | I | Hydrophobic | Thermoplastic | 32 | 72 | 200 | 5.1 | 0.8 | 0.22 |

[Evaluation Methods]

The following explains evaluation methods for each sample (toners of Examples 1 to 13 and Comparative Examples 1 to 6.

(High-Temperature Preservability)

A 20 mL polyethylene container containing 2 g of a sample (toner) was left to stand for 3 hours in a thermostatic chamber set to 60° C. to give a high-temperature preservability evaluation sample. The high-temperature preservability evaluation sample was sifted using a 100 mesh (opening: 150 μm) sieve set in a powder tester (product of Hosokawa Micron Corporation) in accordance with a manual of the powder tester at a rheostat level of 5 for 30 seconds. After sifting, the mass of the sample remaining on the sieve was measured. The mass of the sample before sifting and the mass of the sample remaining on the sieve after sifting were used to calculate a degree of aggregation (% by mass) of the sample based on the following equation. High-temperature preservability of the sample was evaluated based on the calculated degree of aggregation of the sample, in accordance with the following criteria.

Degree of aggregation (% by mass)=100×mass of sample remaining on sieve after sifting/mass of sample before sifting VG (Very Good): Degree of aggregation of no greater than 30% by mass G (Good): Degree of aggregation of greater than 30% by mass and no greater than 50% by mass P (Poor): Degree of aggregation of greater than 50% by mass (Charge Decay Constant)

A charge decay constant $\alpha$ of a toner (charge decay constant of toner particles) was measured by a method in accordance with JIS C 61340-2-1 using an electrostatic dissipation measuring device ("NS-D100", product of Nano Seeds Corporation). The following describes a measurement method of the charge decay constant of a toner in detail.

A sample (the toner) was added into a measurement cell. The measurement cell was a metal cell having a recess of internal diameter 10 mm and depth 1 mm. The sample was loaded into the recess of the cell, pressing on the sample from above using slide glass. Any of the sample that overflowed from the cell was removed by moving the slide glass back and forth on the surface of the cell. No less than 0.04 g and no greater than 0.06 g of the sample was loaded into the cell.

Next, the measurement cell having the sample loaded therein was left for 12 hours in ambient conditions of 32° C. and 80% relative humidity. The grounded measurement cell was subsequently placed in the electrostatic dissipation measuring device and ions were supplied to the sample by corona discharge to charge the sample for 0.5 seconds. The surface potential of the sample was measured continuously starting from 0.7 seconds after completion of corona discharge in ambient conditions of 32° C. and 80% relative humidity. The charge decay constant (charge decay rate) $\alpha$ was calculated based on the surface potential measurement values and the equation $V=V_0\exp(-\alpha\sqrt{t})$. In the equation, V represents surface potential [V], $V_0$ represents initial surface potential [V], and t represents decay time [s].

The calculated charge decay constant $\alpha$ was evaluated in accordance with the following criteria.

VG (Very Good): Charge decay constant $\alpha$ of the sample of less than 0.015

G (Good): Charge decay constant $\alpha$ of the sample of no less than 0.015 and less than 0.020

P (Poor): Charge decay constant $\alpha$ of the sample of no less than 0.020

Low-temperature fixability, transfer efficiency, and drum adhesion of the sample (toner) were evaluated using a two-component developer prepared in accordance with the following method.

An evaluation two-component developer was prepared by mixing a developer carrier (carrier for "TASKalfa5550ci", product of KYOCERA Document Solutions Inc.) and 10% by mass of the toner relative to mass of the developer carrier for 30 minutes using a ball mill.

(Low-Temperature Fixability)

Images were formed using the two-component developer prepared as described above to evaluate low-temperature fixability of the toner. A color printer ("FS-C5250DN", product of KYOCERA Document Solutions Inc., modified to form an evaluation apparatus having adjustable fixing temperature) having a roller-roller type heat pressure fixing device (nip width 8 mm) was used as an evaluation apparatus. The two-component developer prepared as described above was loaded into a developing device of the evaluation apparatus and the sample (toner) was loaded into a toner container of the evaluation apparatus.

In order to evaluate fixability of the sample (toner), the evaluation apparatus was used to form a solid image with a size of 25 mm×25 mm and a coverage of 100% on 90 g/m$^2$ paper (A4 size printing paper) under conditions of a linear speed of 200 mm/sec (nip passage time 40 msec) and a toner application amount of 1.0 mg/cm$^2$. Next, the paper having the image formed thereon was passed through the fixing device. More specifically, the fixing temperature of the fixing device was gradually increased from 100° C. to measure the minimum temperature at which the toner (solid image) could be fixed to the paper (minimum fixing temperature).

In measurement of the minimum fixing temperature, fixing of the toner was confirmed by a folding and rubbing test such as described below. More specifically, the paper was folded in half such that the surface on which the image was formed was folded inward and a 1 kg weight covered with cloth was rubbed back and forth five times on the fold. Next, the paper was opened out to observe a folded portion of the paper (portion on which the solid image was formed). The length of peeling of the toner (peeling length) in the folded portion was measured. The minimum fixing temperature was determined to be a lowest temperature among fixing temperatures for which the peeling length was less than 1 mm. Low-temperature fixability of the sample was evaluated based on the measured minimum fixing temperature, in accordance with the following criteria.

VG (Very Good): Minimum fixing temperature of the sample of no greater than 150° C.

G (Good): Minimum fixing temperature of the sample of greater than 150° C. and no greater than 160° C.

P (Poor): Minimum fixing temperature of the sample of greater than 160° C.

(Transfer Efficiency and Drum Adhesion)

Transfer efficiency and drum adhesion of the toner were evaluated using an evaluation apparatus ("TASKalfa5550ci", product of KYOCERA Document Solutions Inc.). The above-described developer was set in the evaluation apparatus, and an image with a coverage of 5% was printed on 10,000 sheets at a temperature of 32° C. and a relative humidity of 80% with replenishment of the sample (toner). Mass of consumed toner and mass of collected toner were measured to calculate transfer efficiency of the sample in accordance with the equation shown below. Transfer efficiency of the sample was evaluated in accordance with the following criteria. When a prime mark shaped streak referred to as "a dash mark" was observed in an image region before completion of printing on 10,000 sheets, printing was stopped at the point. In such a case, it was impossible to determine transfer efficiency of the sample.

$$\text{Transfer efficiency (\%)}=[(\text{mass of consumed toner}-\text{mass of collected toner})/(\text{mass of consumed toner})]\times 100$$

VG (Very Good): Transfer efficiency of the sample of greater than 85%

G (Good): Transfer efficiency of the sample of greater than 70% and no greater than 85%

P (Poor): Transfer efficiency of the sample of no greater than 70%

The consumed toner means toner discharged from the toner container out of the sample (toner) put in the toner container. The collected toner means toner that was not transferred to the recording medium out of the consumed toner.

Whether or not a surface of a photosensitive drum in the evaluation apparatus had coloration with the toner and whether or not a dash mark was observed in an image region were confirmed through the printing on 10,000 sheets in order to evaluate drum adhesion of the toner. When a dash mark was observed in an image region before completion of printing on 10,000 sheets, printing was stopped at the point. When printing on 10,000 sheets was not completed, the number of sheets printed until the printing was stopped is shown. The drum adhesion of the sample was evaluated in accordance with the following criteria.

G (Good): No coloration with toner was observed on the surface of the photosensitive drum and no dash mark was observed in an image region.

Poor (Poor): Coloration with toner was observed on the surface of the photosensitive drum and a dash mark was observed in an image region.

[Evaluation Results]

Evaluation results of the samples (toners of Examples 1 to 13 and Comparative Examples 1 to 6) are as follows.

Table 2 shows results of evaluations of the low-temperature fixability, the charge decay constant, the drum adhesion, and the transfer efficiency of the toners.

TABLE 2

| | High-temperature preservability | | Low-temperature fixability | | Charge decay constant | | Drum adhesion | | Transfer efficiency | |
|---|---|---|---|---|---|---|---|---|---|---|
| Example 1 | VG | 20 | VG | 149 | VG | 0.011 | G | None | VG | 92 |
| Example 2 | G | 43 | VG | 143 | VG | 0.013 | G | None | VG | 90 |
| Example 3 | VG | 12 | G | 155 | VG | 0.008 | G | None | VG | 95 |
| Example 4 | VG | 23 | VG | 148 | VG | 0.010 | G | None | VG | 93 |
| Example 5 | VG | 15 | VG | 150 | VG | 0.011 | G | None | VG | 90 |
| Example 6 | VG | 24 | VG | 147 | VG | 0.009 | G | None | VG | 94 |
| Example 7 | VG | 22 | VG | 149 | VG | 0.012 | G | None | VG | 93 |
| Example 8 | G | 48 | VG | 145 | VG | 0.010 | G | None | VG | 93 |
| Example 9 | VG | 8 | G | 157 | VG | 0.012 | G | None | VG | 92 |
| Example 10 | G | 32 | VG | 146 | VG | 0.010 | G | None | VG | 90 |
| Example 11 | VG | 18 | G | 156 | VG | 0.011 | G | None | VG | 94 |
| Example 12 | VG | 28 | VG | 140 | VG | 0.012 | G | None | VG | 89 |
| Example 13 | VG | 16 | VG | 146 | VG | 0.010 | G | None | VG | 91 |
| Comparative Example 1 | G | 42 | VG | 140 | P | 0.340 | G | None | P | 43 |
| Comparative Example 2 | VG | 3 | P | 202 | VG | 0.008 | G | None | VG | 95 |
| Comparative Example 3 | P | 55 | VG | 140 | VG | 0.008 | P | 200 sheets | — | — |
| Comparative Example 4 | VG | 9 | P | 176 | P | 0.139 | G | None | P | 67 |
| Comparative Example 5 | P | 59 | VG | 143 | G | 0.014 | G | None | G | 85 |
| Comparative Example 6 | VG | 8 | P | 168 | VG | 0.008 | P | 800 sheets | — | — |

The toners according to Examples 1 to 13 were toners having the above-described features (1) and (2). More specifically, each of the toners according to Examples 1 to 13 had the following features. That is, the toner particles each included a toner core and a shell layer disposed over a surface of the toner core. The shell layer contained a hydrophilic thermosetting resin and a hydrophobic thermoplastic resin. The hydrophobic thermoplastic resin was contained in an amount of no less than 0.2% by mass and no greater than 4.7% by mass relative to mass of the toner particles. The hydrophilic thermosetting resin was contained in an amount of no less than 0.01% by mass and no greater than 0.71% by mass relative to mass of the toner particles. The hydrophobic thermoplastic resin was exposed at a surface of each of the toner particles.

As shown in Table 2, each of the toners according to Examples 1 to 13 was excellent in low-temperature fixability and high-temperature preservability. Each of the toners according to Examples 1 to 13 showed a smaller charge decay constant and had excellent charge retention. In addition, charge decay of each of the toners according to Examples 1 to 13 was restricted. Furthermore, each of the toners according to Examples 1 to 13 was also excellent in drum adhesion and transfer efficiency.

What is claimed is:

1. An electrostatic latent image developing toner comprising:

toner particles that each include a toner core and a shell layer disposed over a surface of the toner core, wherein the shell layer contains a hydrophobic thermoplastic resin and a hydrophilic thermosetting resin, the hydrophobic thermoplastic resin is contained in an amount of no less than 0.2% by mass and no greater than 4.7% by mass relative to mass of the toner particles, the hydrophilic thermosetting resin is contained in an amount of no less than 0.01% by mass and no greater than 0.71% by mass relative to mass of the toner particles, and the hydrophobic thermoplastic resin is exposed at a surface of each of the toner particles.

2. The electrostatic latent image developing toner according to claim 1, wherein the shell layer includes a plurality of blocks and a junction portion, the plurality of blocks being connected to one another via a junction portion, the plurality of blocks are substantially composed of the hydrophobic thermoplastic resin, and the junction portion is substantially composed of the hydrophilic thermosetting resin.

3. The electrostatic latent image developing toner according to claim 1, wherein the hydrophobic thermoplastic resin is contained in an amount of no less than 0.5% by mass and no greater than 2.7% by mass relative to mass of the toner particles, and the hydrophilic thermosetting resin is contained in an amount of no less than 0.06% by mass and no greater than 0.36% by mass relative to mass of the toner particles.

4. The electrostatic latent image developing toner according to claim 1, wherein the hydrophilic thermosetting resin is one or more resins selected from the group consisting of a melamine resin, a urea resin, and a glyoxal resin.

5. The electrostatic latent image developing toner according to claim 1, wherein the hydrophobic thermoplastic resin has a glass transition point of no less than 45° C. and no greater than 100° C.

* * * * *